US007886372B2

(12) United States Patent
Jacobs

(10) Patent No.: US 7,886,372 B2
(45) Date of Patent: Feb. 15, 2011

(54) DRAIN ASSEMBLY FOR RAPID INSTALLATION IN SANITARY VESSELS

(75) Inventor: Barry H. Jacobs, Highland Park, NJ (US)

(73) Assignee: AS IP Holdco, L.L.C., Piscataway, NJ (US)

( * ) Notice: Subject to any disclaimer, the term of this patent is extended or adjusted under 35 U.S.C. 154(b) by 1085 days.

(21) Appl. No.: 11/217,875

(22) Filed: Sep. 1, 2005

(65) Prior Publication Data

US 2006/0179564 A1 Aug. 17, 2006

Related U.S. Application Data

(60) Provisional application No. 60/652,402, filed on Feb. 11, 2005.

(51) Int. Cl.
*A47K 1/14* (2006.01)

(52) U.S. Cl. ..... 4/295

(58) Field of Classification Search ..... 4/684, 4/685, 689–692
See application file for complete search history.

(56) References Cited

U.S. PATENT DOCUMENTS

| | | | | |
|---|---|---|---|---|
| 645,639 | A | 3/1900 | Bunting, Jr. | |
| 2,063,399 | A | 12/1936 | Rasmussen | |
| 2,553,991 | A * | 5/1951 | Wagner et al. | 4/692 |
| 3,002,196 | A * | 10/1961 | Mackey, Jr. | 4/689 |
| 4,085,469 | A | 4/1978 | Petursson | |
| 4,411,028 | A * | 10/1983 | Hogner | 4/691 |
| 5,333,327 | A | 8/1994 | Redding et al. | |
| 5,822,812 | A * | 10/1998 | Worthington et al. | 4/689 |
| 6,023,795 | A | 2/2000 | Pötter et al. | |
| 6,367,102 | B1 | 4/2002 | McMullen | |

(Continued)

FOREIGN PATENT DOCUMENTS

EP 0 081 048 A2 6/1983

(Continued)

OTHER PUBLICATIONS

European Search Report issued in European Patent Application 05 02 8453 on Apr. 27, 2007, 1 pg.

*Primary Examiner*—Lori Baker
(74) *Attorney, Agent, or Firm*—Flaster/Greenberg, P.C.

(57) ABSTRACT

The present invention provides an improved drain assembly having a drain stopper assembly in operational communication with an actuation assembly. The drain stopper assembly includes an elongate one-piece housing with a longitudinal body coextensive with proximal and distal extents of the housing and defining a lumen therein. A flange portion at the proximal extent has a fluid egress for delivery of fluids from a sanitary vessel to the housing lumen. The housing body has an inner circumferential surface of predetermined inner diameter and an outer circumferential surface of predetermined outer diameter. A linearly reciprocatable drain stopper is provided that has a closure head proximate which an elongate shaft depends. The stopper reciprocates between a fully closed position, wherein the closure head obstructs the fluid egress, and a fully open position, wherein the fluid egress remains unobstructed. A securement region provided on the outer housing surface has a receiving region defined therewith and effects operational communication between the drain stopper assembly and the actuation assembly so that operation of a drain articulation member effects reciprocal motion of the drain stopper. In this embodiment, the housing, flange portion and securement region comprise an integral member. In an alternative embodiment, the drain stopper assembly has a multi-piece housing.

69 Claims, 12 Drawing Sheets

U.S. PATENT DOCUMENTS

2006/0156460 A1 7/2006 Von Mertz et al.

FOREIGN PATENT DOCUMENTS

EP 0 081 048 B1 6/1986
EP 0 949 385 A2 10/1999
FR 2 321 864 3/1977
GB 1 441 964 7/1976
WO WO 2005/012657 A1 2/2005

* cited by examiner

DRAIN ASSEMBLY FOR RAPID INSTALLATION IN SANITARY VESSELS

CROSS-REFERENCE TO RELATED APPLICATIONS

This application claims priority to Applicant's U.S. Application Ser. No. 60/652,402, filed Feb. 11, 2005, and incorporated by reference herein.

BACKGROUND OF THE INVENTION

1. Field of the Invention

The present invention is directed to an apparatus for effecting effortless installation of a drain apparatus in a sanitary vessel such as a sink or basin. The drain apparatus of the present invention incorporates structure that attenuates the time required for installation and/or maintenance of conventional drain assemblies without compromising the function thereof. In this manner, the present invention enhances the operation of newly installed and pre-installed sanitary vessels 2. Description of Related Art Installation and maintenance of sanitary vessels requires substantial investments of fiscal and temporal resources. Although consumers must often make difficult decisions concerning the extent to which certain functional and aesthetic features can feasibly be incorporated into a product, the same consumers repeatedly demand ease of installation and maintenance of their products.

There have been numerous attempts to address these demands. U.S. Pat. No. 645,639 to Bunting, Jr., for instance, discloses a washbasin having a handle in operable communication with a vertical shaft that is disposed in a sleeve. A horizontal shaft is provided in a tubular projection that is connected to a waste pipe to facilitate free rotation of the horizontal shaft therewithin. A spring is adjustably connected to adjacent ends of the vertical and horizontal shafts so that, upon turning of the handle, the horizontal shaft also rotates. The basin also includes a plug with an annular groove engaged by an eccentric pin on an adjacent end of the horizontal shaft. In this configuration, rotation of the horizontal shaft causes elevation of the plug and further rotation lowers the plug.

U.S. Pat. No. 2,063,399 to Rasmussen discloses a waste and overflow device for bathtubs and basins. The device includes a fitting having a short tube over which a plug stem sits. The stem is formed at its lower end with an outwardly projecting lug that passes through a correspondingly configured notch when placed in alignment therewith such that turning of the plug prevents withdrawal of the plug from the fitting. An overflow head is also provided that includes an opening to which a tube is mounted. The tubes are connected by a flexible shaft having a tapered valve at an operating extent thereof. The valve, when raised, correspondingly closes the opening in of the short tube. An upper end of the flexible shaft is connected with a handle so as to be guided thereby. When it is desired to open the plug, actuation of the handle correspondingly moves the flexible shaft, thereby lifting the plug from its seated position.

U.S. Pat. No. 4,085,469 to Petursson discloses a drain plug in the outlet of a plumbing fixture such as a lavatory basin or bath. A flexible cable loosely resides within a flexible tube that extends through both overflow and drain pipes. The flexible cable connects the plug with a waste control handle, and a simple attachment clip permits ready installation or replacement thereof.

U.S. Pat. No. 5,333,327 to Redding et al. discloses a mechanism for remotely opening and closing a basin drain by utilizing a flexible rod movably disposed within a non-linear tube. The rod connects a user-driven member with a linkage member having a plug in communication therewith, such that pushing or pulling the drive member correspondingly moves the plug and effects opening and closing of the drain. Within a bend of the tube, a void is desirably defined between the rod and the tube to reduce friction. The configuration of the rod may include one or more bulbous ends or a lobed cross-section.

U.S. Pat. No. 6,367,102 discloses a drain assembly having a movable stopper guide that aligns a drain flange to a drain body from above a sink within which the drain assembly is installed. The stopper guide supports a stopper at an upper end thereof to effect closing of a drain opening. The stopper guide has an axial opening to accommodate an axial fastener that joins the drain flange and drain body to the basin. The stopper guide also has downwardly extending legs defining an axial slot extending from the axial opening to accommodate cross-members that extend laterally between the drain flange and drain body. The drain flange can be aligned with the drain body by engaging the drain flange cross-member and rotating such cross-member as appropriate.

None of the aforementioned solutions discloses a drain apparatus that combines optimal installation structure and drain stopper functions in a drain assembly that readily installs in sanitary vessels without any adjustments made by the user. It is therefore desirable to provide a drain apparatus having such advantages over existing drain assemblies that incur deleterious investments of temporal and fiscal resources due to prolonged installation of such devices.

BRIEF SUMMARY OF THE INVENTION

It is an advantage of the present invention to provide a drain apparatus that significantly reduces the time and effort associated with installation thereof, as compared to conventional drain stopper mechanisms. Such a drain apparatus desirably obviates the need for tools, plumber's putty or caulk to ensure proper alignment and sealing characteristics.

It is another advantage of the present invention to provide a drain apparatus that readily installs and functions in a plurality of sanitary vessel configurations without detracting from the aesthetic appeal thereof. Such a drain apparatus desirably imparts enhanced aesthetic qualities in applications where the drain apparatus is visible beneath a sanitary vessel within which the drain apparatus is employed.

It is a further advantage of the present invention to provide a drain apparatus that facilitates actuation of a stopper portion thereof without compromising seal integrity. Such a drain apparatus desirably induces sufficient tightening of the appropriate elements thereof so as to effect a leak proof seal upon initial installation in a sanitary vessel.

In accordance with these and other advantages, the present invention provides an improved drain assembly for use in sanitary vessel. The drain assembly of the present invention comprises a drain stopper assembly having an elongate one-piece housing with a longitudinal axis defined therealong. The housing has a proximal extent for disposal proximate a vessel surface, an opposing distal extent for disposal proximate a waste outlet and a longitudinal body coextensive extent with both of the proximal and distal extents and defining a lumen therein. The housing body includes each of an inner circumferential surface of predetermined inner diameter and an outer circumferential surface of predetermined outer diameter. A flange portion at the proximal extent has a fluid egress for delivery of fluids from the sanitary vessel to the housing lumen. The drain stopper assembly further includes a linearly reciprocatable drain stopper having a closure head from which an elongate shaft depends generally normally so that a longitudinal axis thereof is coincident with the housing longitudinal axis. The shaft has a proximal extent adjacent the closure head and an opposing free extent disposed in the housing lumen. The stopper reciprocates between a fully closed position, wherein the closure head obstructs the fluid egress, and a fully open position, wherein the fluid egress remains unobstructed. A securement region provided on the outer housing surface has a receiving region defined therewith. The present invention drain assembly further includes an actuation assembly having a motion translation device in communication with a drain articulation member. The securement region effects operational communication between the drain stopper assembly and the actuation assembly so that operation of the drain articulation member effects reciprocating motion of the drain stopper. The housing, flange portion and securement region comprise an integral member.

In an alternative embodiment, the present invention provides an improved sanitary drain assembly comprising a drain stopper assembly with a multi-piece housing. The housing includes a proximal extent for disposal proximate a vessel surface, at which proximal extent a flange portion is provided with a fluid egress for delivery of fluid therethrough. An opposing distal extent is also provided at which a fluid conduit in fluid communication therewith delivers fluid from the drain stopper assembly. The housing further includes a drain insert disposed in a lumen of a drain body so as to accommodate a reciprocatable stopper thereby. The stopper having a closure head from which an elongate shaft depends generally normally and which obstructs the fluid egress when the stopper is in a closed position. The shaft has a proximal extent adjacent the closure head and an opposing free extent disposed in the drain insert when the stopper is in a closed position. The drain body has each of an inner circumferential surface of predetermined inner diameter and an outer circumferential surface of predetermined outer diameter. A securement region is positioned along the outer circumferential surface of the drain body and terminates in a distal extent. Such distal extent does not extend beyond the predetermined outer diameter of the housing outer surface. The securement region effects operational communication between the drain stopper assembly and an actuation assembly having a motion translation device in communication with a drain articulation member so that operation of said drain articulation member effects reciprocal motion of said drain stopper.

The present invention also provides an improved sink drain assembly comprising a drain stopper assembly and an actuation assembly in operative communication therewith so that operation of a drain articulation member effects reciprocal motion of a drain stopper. The actuation assembly comprises a motion translation device in communication with the drain articulation member and a motion transfer mechanism that facilitates operative communication between the motion translation device and the drain stopper assembly.

DETAILED DESCRIPTION OF THE INVENTION

Figure 1:
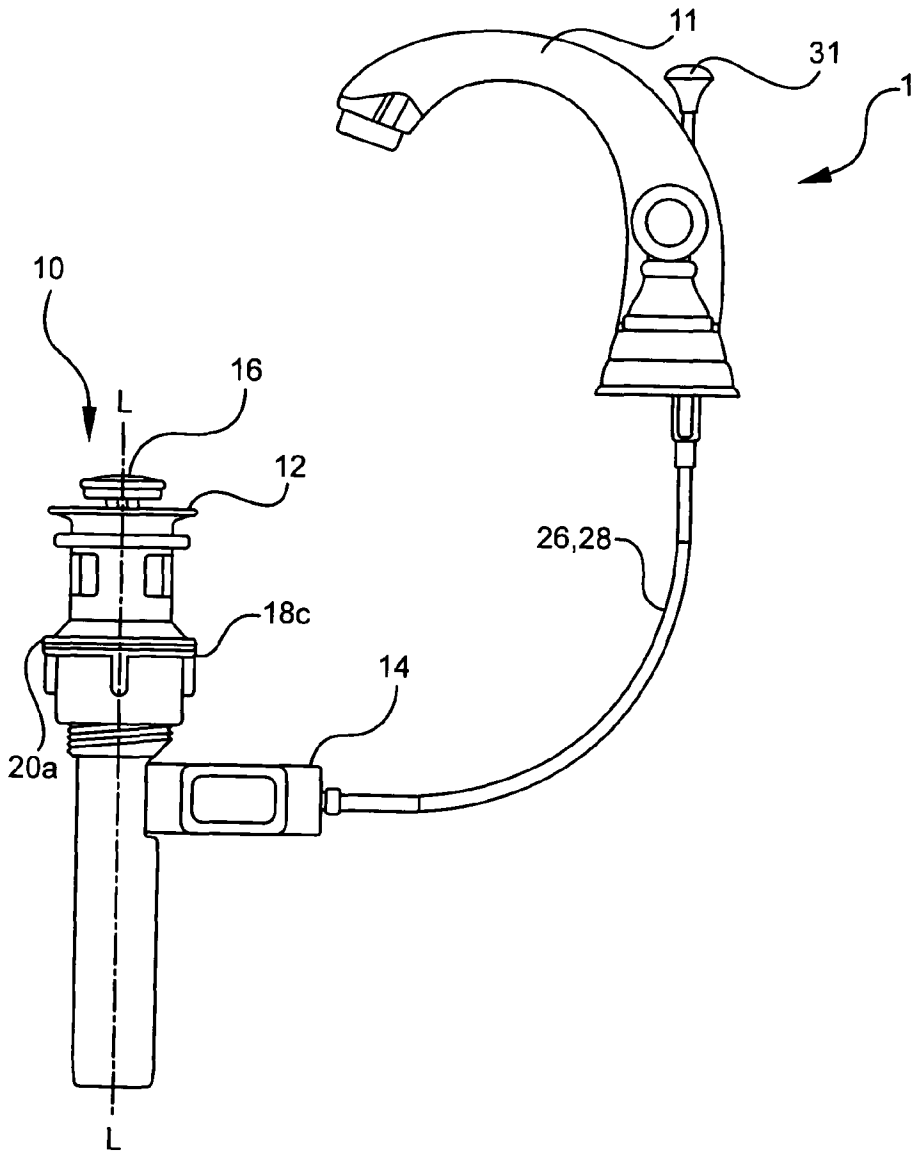
FIG. 1 is a side perspective view of a drain assembly of the present invention in combination with a sanitary fitting.
Figure 5:
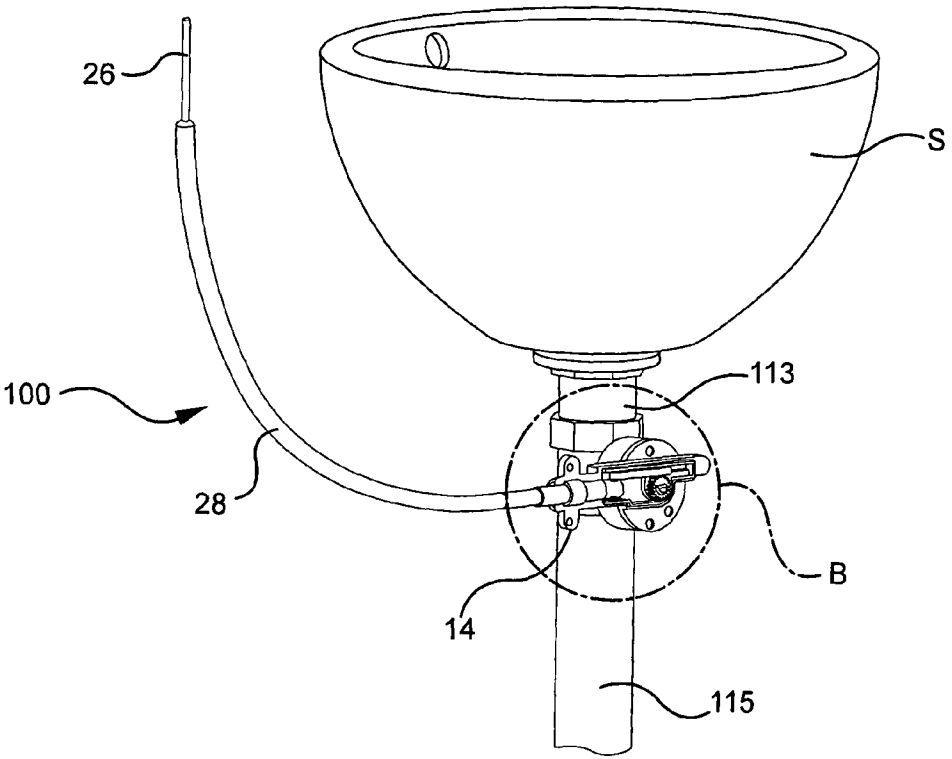
FIG. 5 is a sanitary vessel incorporating an alternative embodiment drain stopper assembly for use in the drain assembly of the present invention.
Figure 5B:
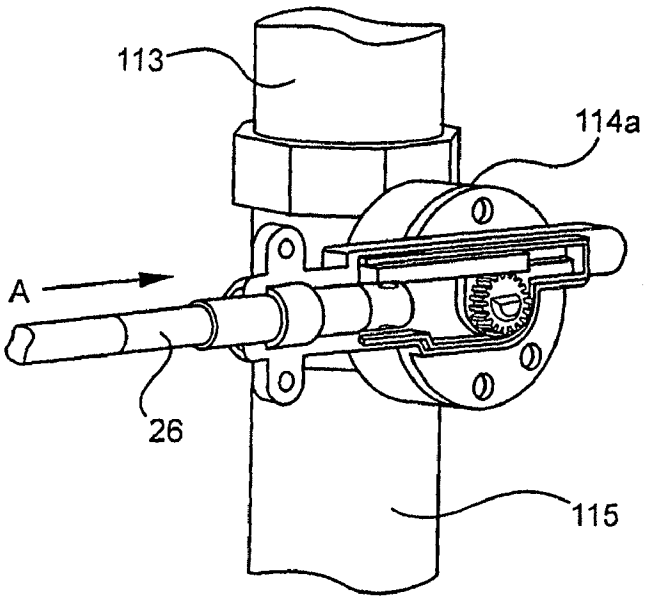
FIG. 5B is an enlarged view of Section B of FIG. 5.
Figure 5A:
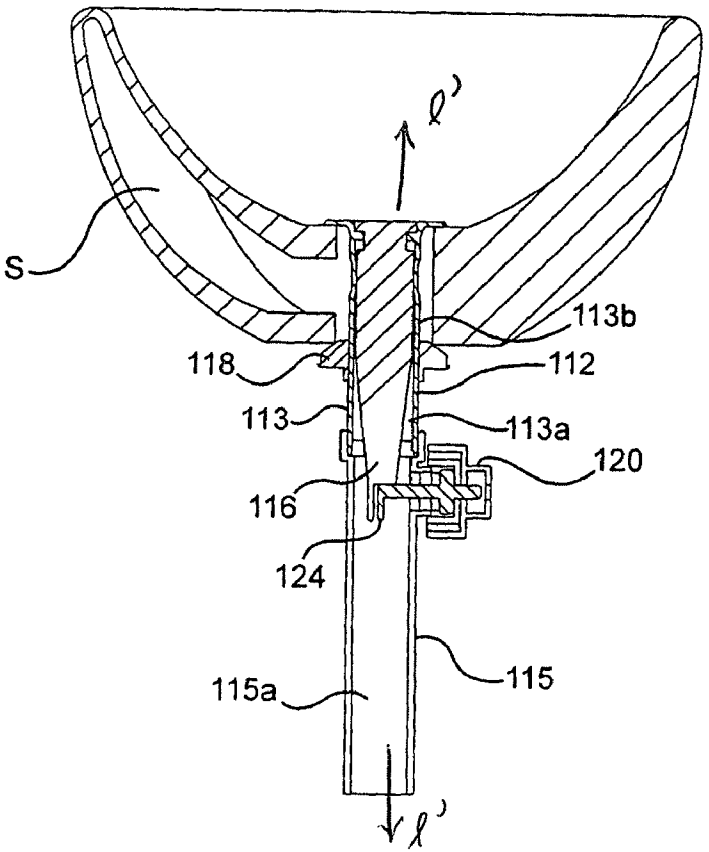
FIG. 5A is a sectional view of the sanitary vessel of FIG. 5.
Figure 6A:
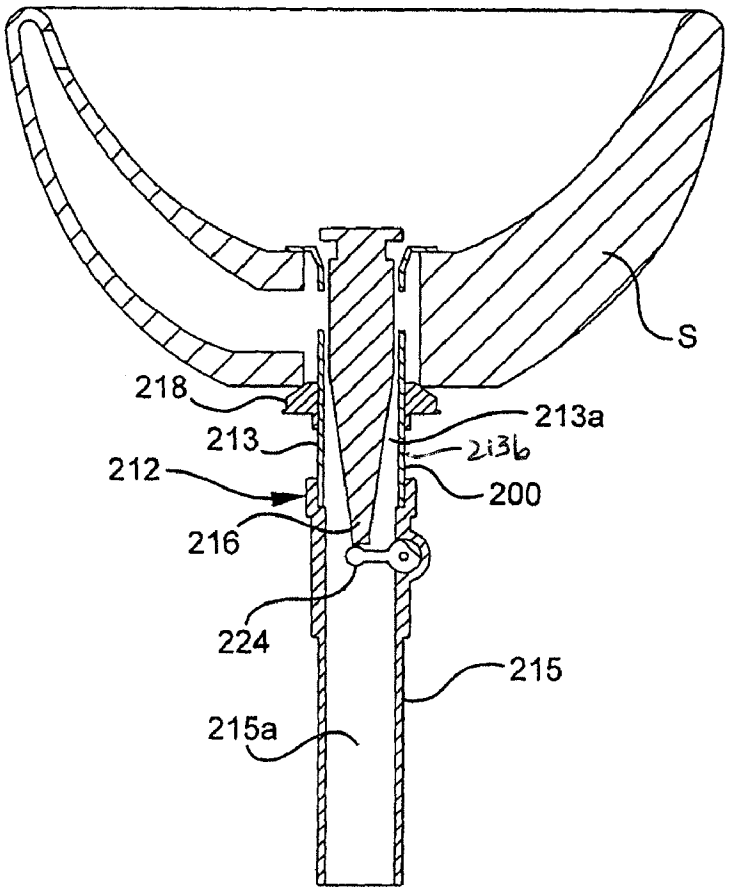
FIG. 6A is a sectional view of the sanitary vessel of FIG. 6.
Figure 6:
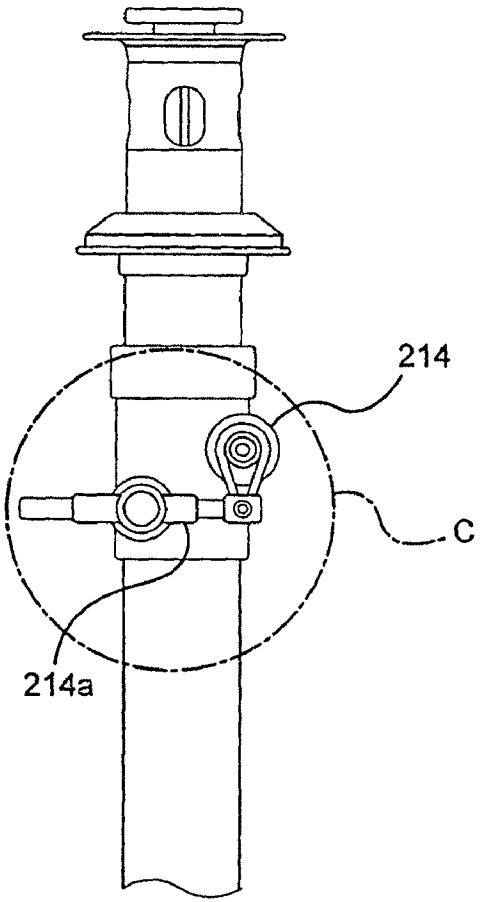
FIG. 6 is a perspective view of a second alternative embodiment drain stopper assembly for use in the drain assembly of the present invention.

Now referring to the Figures, wherein like numerals identify like elements, FIG. 1 shows a drain apparatus and sanitary fitting system 1 that includes drain assembly 10 of the present invention for use within a sanitary vessel, such as a sink or basin S (shown in FIGS. 5A and 6). Drain assembly 10 is depicted in combination with sanitary fitting 11, shown herein as a dual handle lavatory faucet. It is understood, however, that sanitary fitting 11 may comprise any configuration that is amenable to successful operation of the present invention, including but not limited to kitchen faucets, bath fillers, bidet fittings and the like.

Drain assembly 10 includes a drain stopper assembly 12 detachably coupled with an actuation assembly 14 such that operation of the latter effects reciprocal motion of drain stopper 16. Movement of stopper 16 between open and closed positions corresponds to actuation of a rotating knob or lift member in communication with actuation assembly 14, as further described hereinbelow. The lift or knob is desirably disposed in a predetermined position at the manufacturing site to ensure that the enhanced aesthetic appearance of the sanitary fitting system is predictable and repeatable.

Drain stopper assembly 12 has an elongate one-piece housing 13 with a longitudinal axis 1 defined therealong. Housing 13 includes a proximal extent 13*a* for disposal proximate a vessel surface (not shown), an opposing distal extent 13*b* for disposal proximate a waste outlet (as is known in the art and not shown herein) and a longitudinal body 13*c* coextensive therewith. Housing body 13*c* has an outer circumferential surface 13*e* thereabout having outer diameter $D_o$ defined thereat. Housing body 13*c* further has an inner circumferential surface 13*d* similarly defined by inner diameter $D_i$ and delineating the parameters of lumen 13*f*. Outer diameter $D_o$ desirably approaches 41 mm (but is not limited thereto) as is consistent with applicable sanitary codes, and inner diameter $D_i$ is defined as large as possible to permit unencumbered fluid flow through lumen 13*f*. Di may vary along the extent of so that lumen 13*f* tapers along at least a portion of housing body 13*c*.

Proximal extent 13*a* further includes a flange portion 13*g* having a fluid egress 15 for delivery of fluids from a sanitary vessel to lumen 13*f*. Flange portion 13*g*, which can extend generally outwardly relative to axis L-L as shown, is seated at or on a vessel surface and supported thereby when drain assembly 10 is installed therein. Although flange portion 13*g* is desirably fabricated as an integral portion of one-piece housing 13, it is anticipated that flange portion 13*g* may be separately formed from housing 13 and subsequently integrated therewith. An optional sealing member 500 is selectively placed proximate flange portion 13*g* to provide optimal sealing capabilities at the location of fluid delivery from the vessel to drain stopper assembly 12. Sealing member 500 may be selected from a variety of applicable materials as are known in the industry, although foam is specifically desired to accommodate the compression anticipated by hand tightening of drain assembly 10 upon installation thereof.

Lumen 13*f* accommodates placement of linearly reciprocatable drain stopper 16 therewithin. Stopper 16 has a closure head 16*a* from which an elongate shaft 16*b* depends generally normally so that a longitudinal axis thereof is coincident with axis L-L. Shaft 16*b* includes proximal extent 16*b*' adjacent closure head 16*a* and opposing free extent 16*b*" disposed in lumen 13*f*. Closure head 16*a* selectively obstructs fluid egress 15 when stopper 16 is in a closed position.

It is understood that alternate stopper designs may be employed without departing from the scope of the present invention. As further shown in FIG. 3, a stopper 16' is shown that is similar to stopper 16 but for the integration of at least one tapered wing portion 17 defined along at least a portion of the stopper shaft. At least one tapered portion 17, either alone or in combination with one or more wings 17*a* protruding therefrom, guides stopper 16' into optimal alignment in lumen 13*f* to facilitate fluid flow therein. In addition, stopper 16 may also include at least one locking member 16*c* defined at the free extent thereof (as depicted with respect to alternative stopper 16' in FIG. 3 and further illustrated in FIG. 4), although such configuration is not essential to the successful operation of the present invention. Locking member 16*c* captures a middle finger 74 that communicates with stopper 16 and imparts reciprocating movement thereto (as further described hereinbelow), thereby presenting the inadvertent separation of stopper 16 from drain assembly 10. Locking member 16*c* is depicted as a barb with an aperture through which finger 74 extends, thereby serving as a stop against perpetual upward movement of stopper 16. It is understood, however, that while such a feature desirably facilitates pre-installation of stopper 16 in drain assembly 10, locking member 16*c* may assume any one of a plurality of configurations that are well known in the art and that provide an essentially integral drain assembly capable of simple installation in a sanitary vessel from a top portion thereof. In this manner, stopper 16 maintains its tightness and alignment relative to the adjacent housing to ensure optimal operation of the drain assembly over a prolonged temporal duration.

Housing 13 supports a gasket nut 18 disposed adjacent outer circumferential surface 13*d* thereof. Gasket nut 18 may include one or more tactile indices 19 to facilitate gripping of the gasket nut or one or more visual indices (such as dashes, color codes and the like, not shown) that illustrate proper alignment of the gasket nut relative to housing surface 13*d*. It is understood that the configuration of such tactile index is not limited to that shown in the Figures and that tactile and/or visual indices are not essential to the practice of the present invention.

Gasket nut 18 desirably overlies at least a portion of a threaded region 13*h* defined along at least a portion of housing body 13*b*. Gasket nut 18 easily slides thereover, thereby obviating superfluous tightening operations inherent in the installation of conventional drain assembly configurations. Gasket nut 18 may include one or more threads 18*a* along interior circumferential surface 18*b* that cooperate with one or more threads along threaded region 13*h*. Although not essential to practice of the present invention, gasket nut 18 desirably exhibits a height of 28 mm, using 10 mm of threads to accommodate 18 mm of adjustability along threaded region 13*h*, thereby satisfying the ASME prescribed range of ¼" for the depth of a sink drain hole.

In order to realize an optimal seal along outer circumferential surface 13*d*, a frustoconical gasket 20 is disposed adjacent gasket nut 18 and overlies a smooth portion 13*i* of housing surface 13*d* above threaded region 13*h*. Unlike conventional drain assemblies, the sealing surface provided by smooth portion 13*i* advantageously eliminates the need to check for fluid leaks and to re-tighten gasket 20 when such leaks are found. An optimal seal between gasket 20 and smooth portion 13*i* is therefore realized by tool or hand tightening upon initial installation of drain assembly 12 in a sanitary vessel. Gasket 20 is desirably fabricated from common durometer rubber as is readily known and available in the industry, although it is contemplated that other plastics and materials may be used in the fabrication thereof without departing from the scope of the present invention.

Gasket nut 18 and frustoconical gasket 20 may sandwich an annular washer 22 therebetween to ensure further sealing function. Washer 22 may be assembled separately between gasket nut 18 and frustoconical gasket 20 as shown. Washer 22 may alternatively be captured by a groove (not shown) defined along either gasket nut contact surface 18*c* or frustoconical gasket contact surface 20*a* (see FIG. 1). Retention may be effected by simple snap fit engagement within a corresponding groove or may be aided by one or more retention members defined either adjacent or within such groove so as to achieve sufficient retention thereby.

Figure 2:
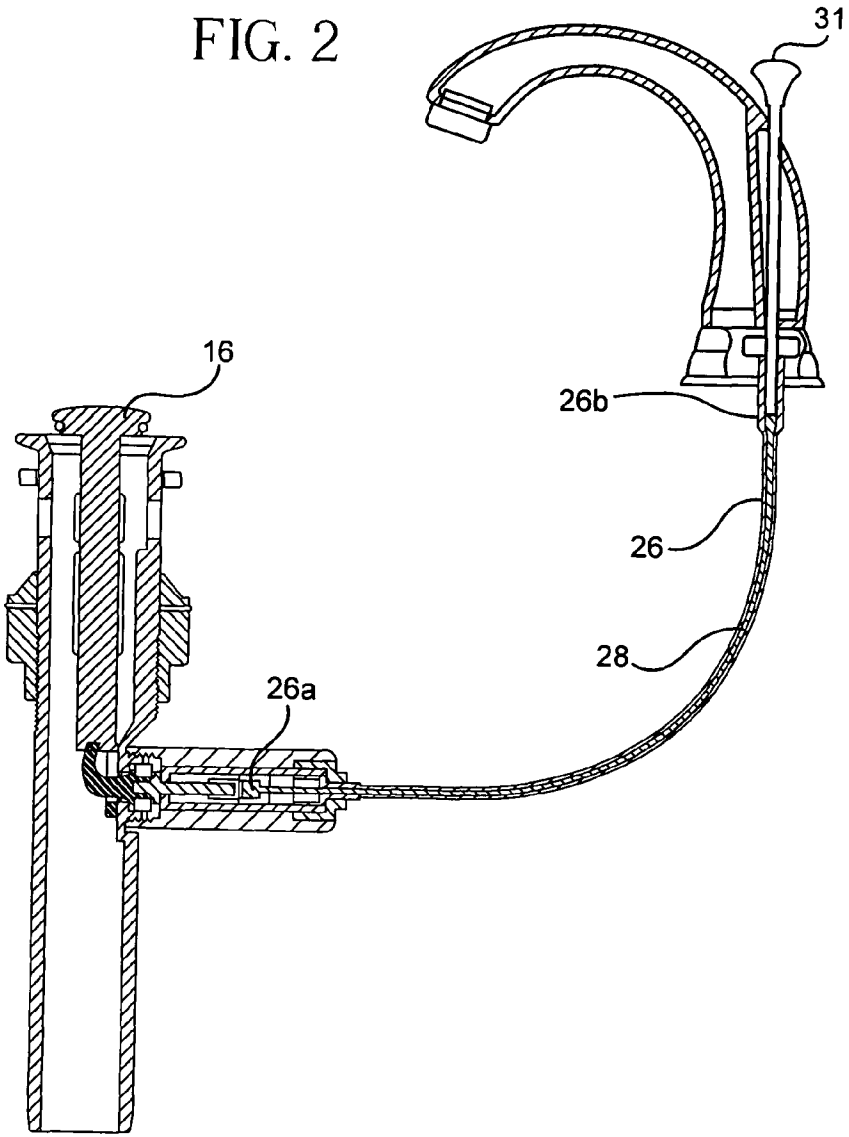
FIG. 2 is a sectional view of the drain assembly and sanitary fitting combination of FIG. 1.
Figure 2A:
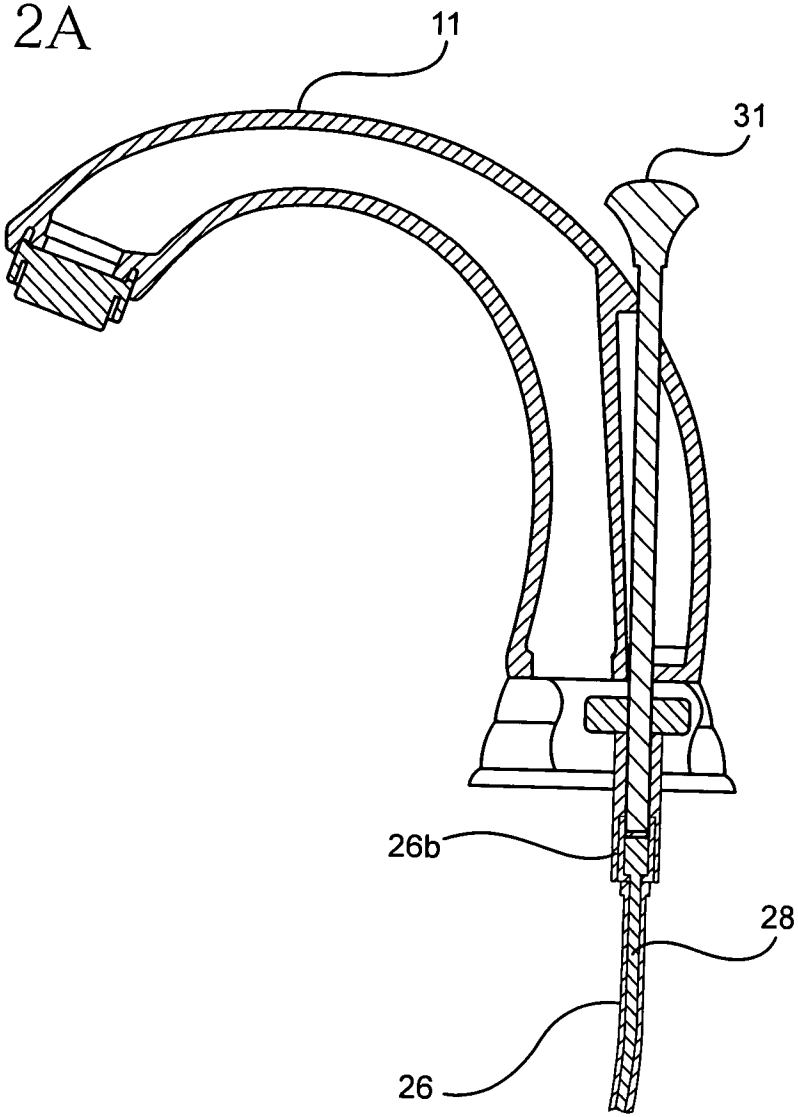
FIG. 2A is a partial view of FIG. 2 showing the sanitary fitting thereof.
Figure 2C:
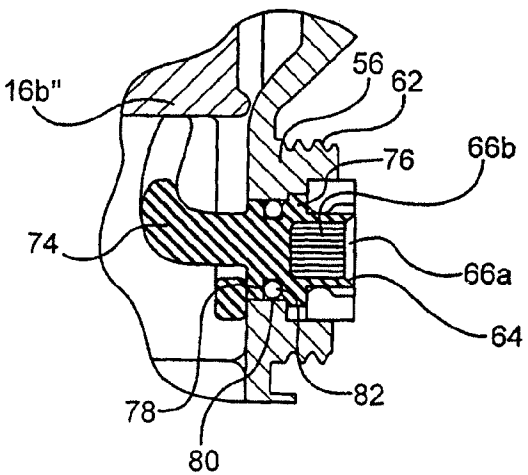
FIG. 2C is an enlarged view of Section A of FIG. 2B, showing a stopper lift cam with a cam receiving region, said cam receiving region not having rotator cam disposed therein.
Figure 3:
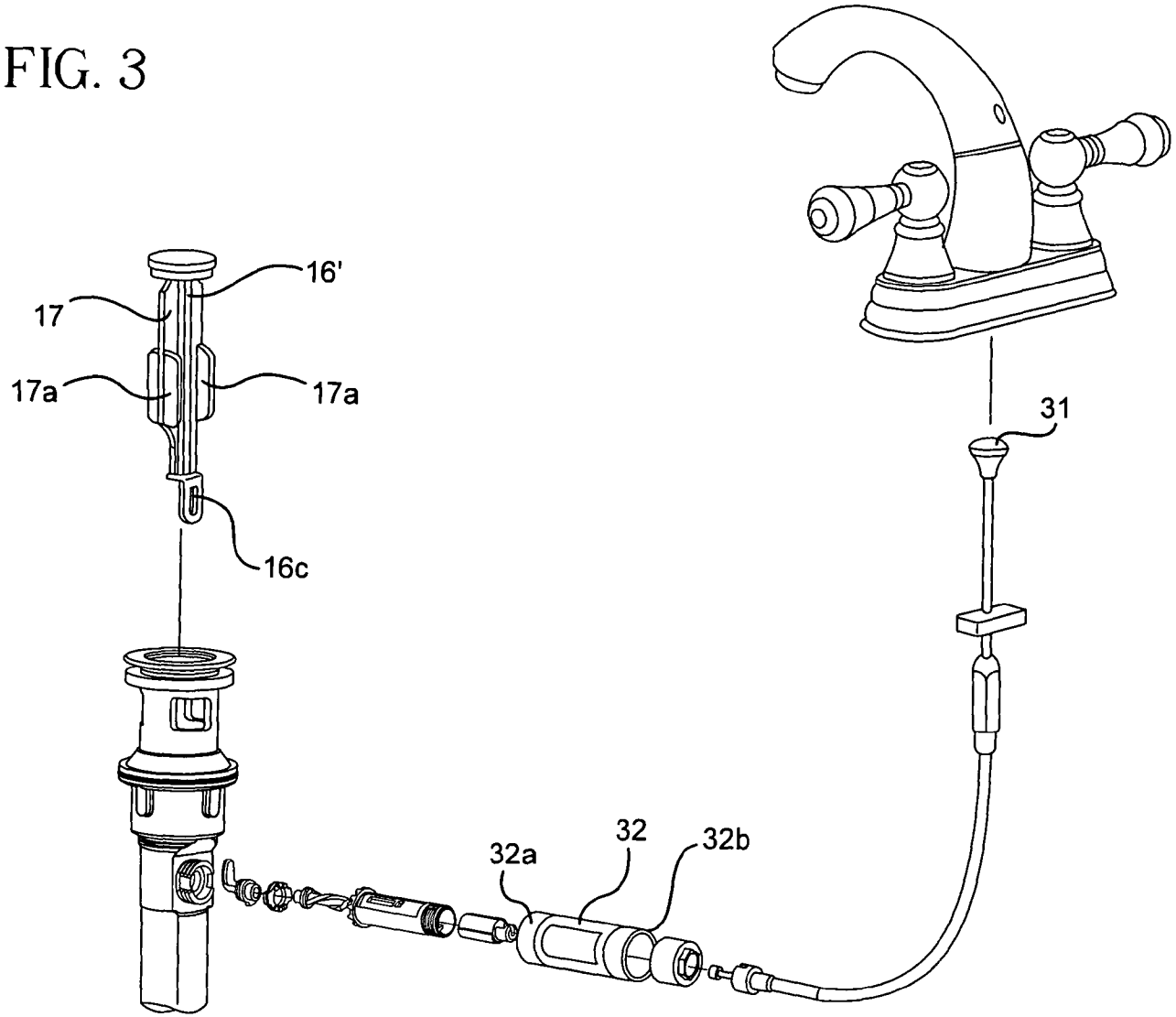
FIG. 3 is an exploded perspective view of the drain apparatus and sanitary fitting combination of FIG. 1.
Figure 3A:
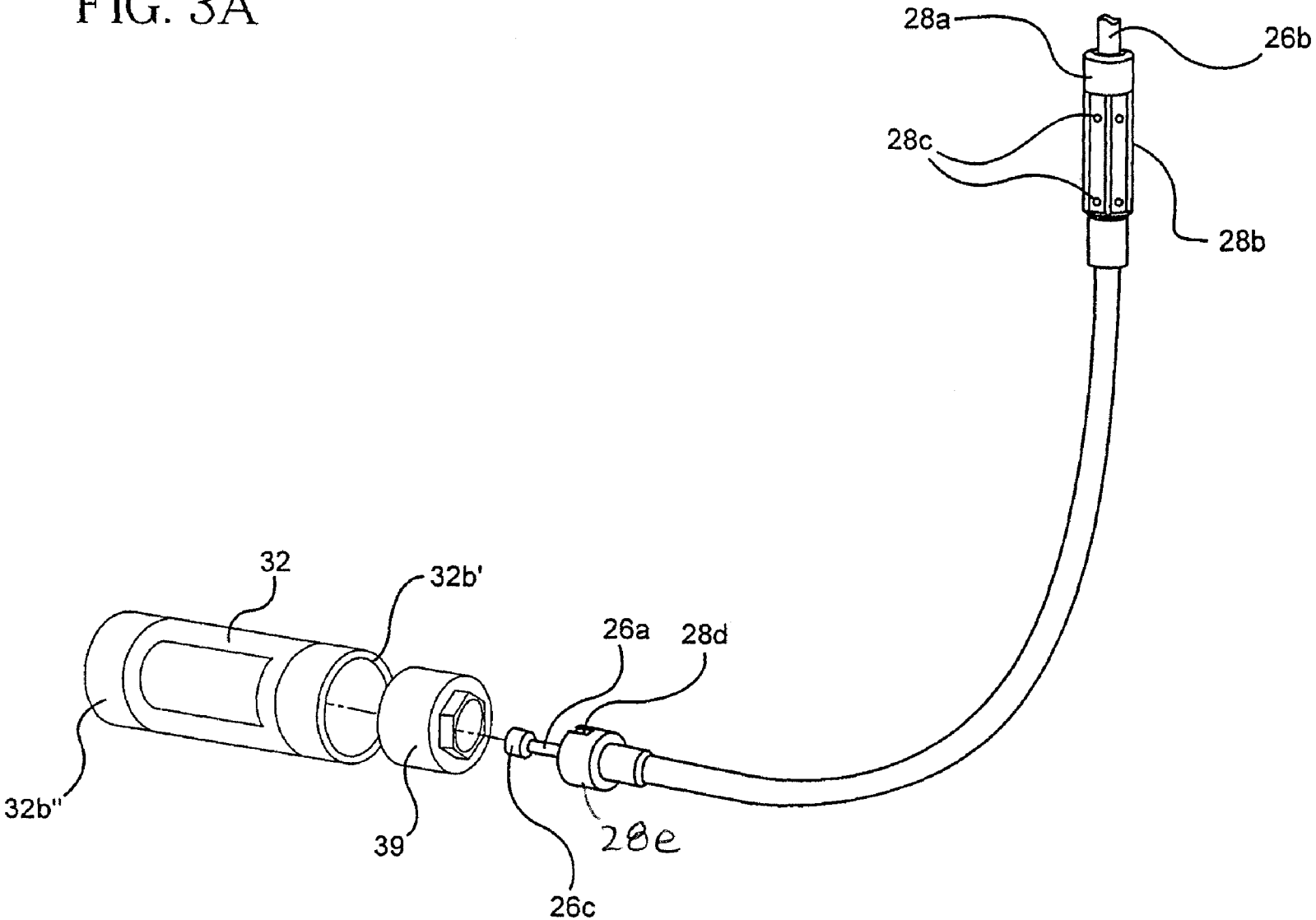
FIG. 3A is a partial view of FIG. 3 showing a motion translation device and portions of a motion transmission mechanism of the drain assembly thereof.
Figure 3B:
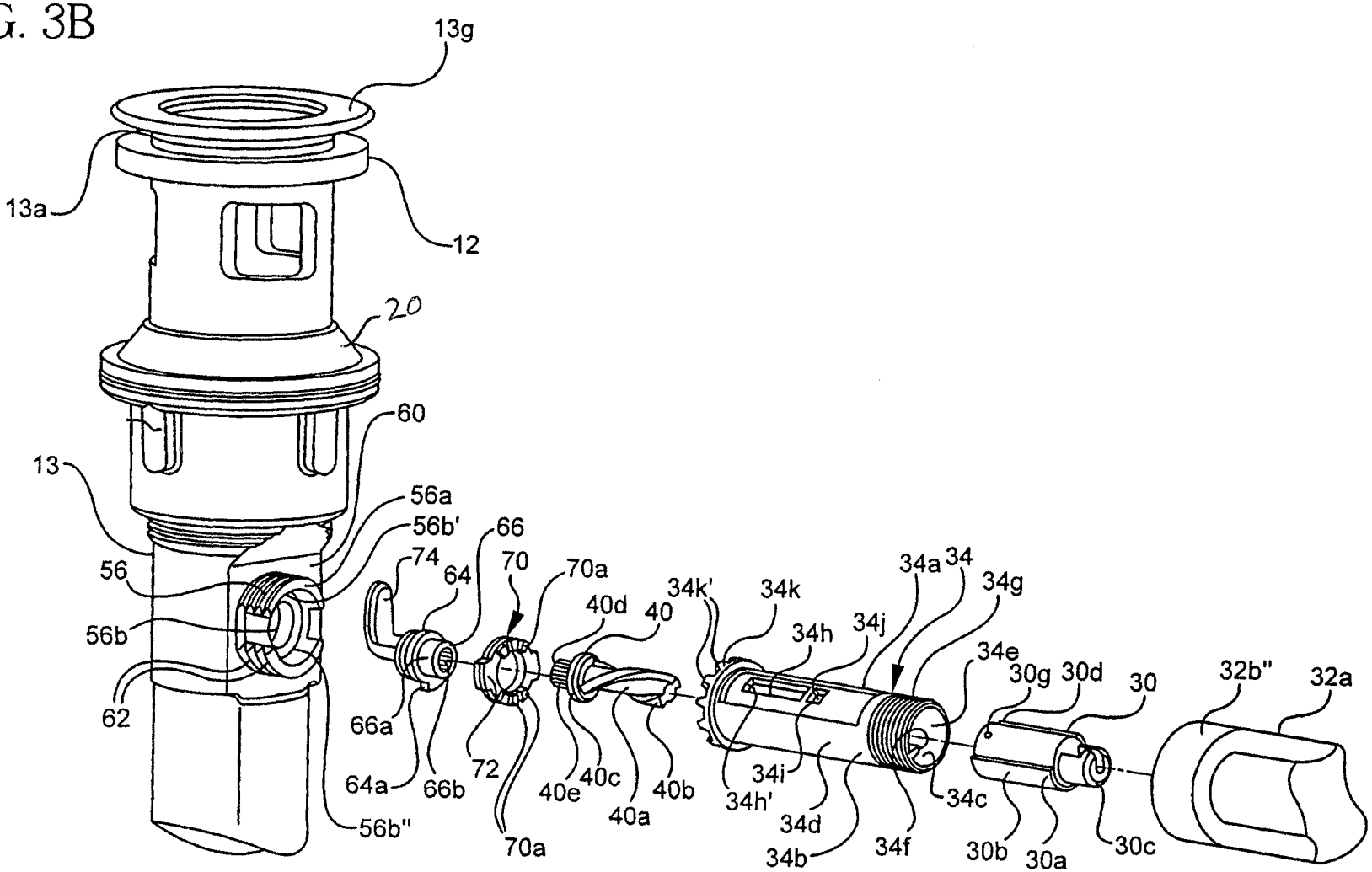
FIG. 3B is a partial view of FIG. 3 showing a drain stopper assembly and actuation assembly of the drain assembly thereof.
Figure 4:
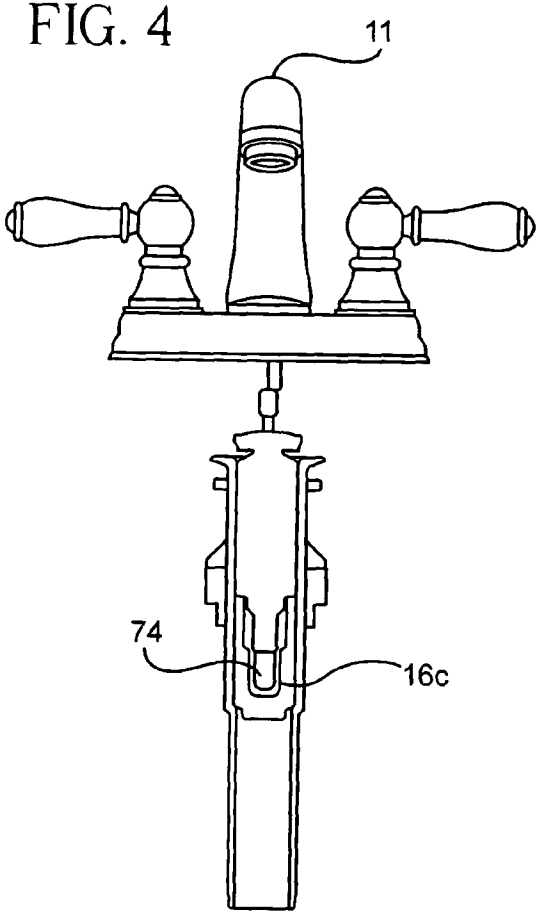
FIG. 4 is a partial sectional view of the drain assembly of FIG. 1 as viewed from the front thereof.

Now referring to FIGS. 2 through 3B, actuation assembly 14 is described in detail. A motion translation device is provided in mechanical communication with one of a plurality of drain articulation devices that are known in the art, including, but not limited to, pivotable levers, pull levers, push buttons, rotatable knobs and handles and comparable motion transmission devices. As shown herein, push-pull cable 26 of predetermined length and diameter is provided in sheath 28 and terminates in a motion output extent 26*a*, a free end of which communicates with reciprocatable slider 30. Opposing motion input extent 26*b* communicates with an actuator such as pull knob 31 (see FIG. 3), by which motion transmission may be effected as appropriate. Cable 26 is desirably fabricated from stainless steel (more desirably, grade 304 stainless steel is used) having a diameter at or about 1.4 to 2.2 mm (wherein 1.8 mm is most preferred), at which cable 26 exhibits sufficient flexibility and stiffness to accomplish the requisite pushing and pulling actions with actuation assembly 14, and a length of about 450 to 550 mm, at which cable 26 accommodates installation of drain assembly 10 in multiple sanitary vessel configurations. Stainless steel prevents rusting and degradation in a moist environment, although other suitable metals, plastics and/or combinations thereof may be used. It is understood that the present invention is not limited to use of a push-pull cable and may instead incorporate a flexible shaft or like device to effect similar ease of installation, operation and maintenance of the present invention.

At motion input extent 28*a* of sheath 28, it is desirable to provide sheath an alignment and guide member 28*b* integral therewith. Member 28*b* facilitates coupling of pull knob 31 (or like actuator) with cable 26 and ensures proper operational alignment thereof while obscuring the entire travel path of pull knob 31. Such configuration not only provides drain assembly 10 with superior function but also elevates the aesthetic appeal thereof. Member 28*b* may include one or more apertures 28*c* defined through a wall thereof, which apertures permit egress of fluid prior to fluid contact with cable 26. This feature desirably protects the integrity of cable 26 and ensures proper operation of drain assembly 10 over a prolonged temporal duration.

Actuation assembly 14 further includes a motion transfer mechanism in the form of carapace 32 having guide 34 and slider 30 in coaxial intussusception therewith. Elongate body 32*a* of carapace 32 defines a lumen 32*b* that retards linear motion of guide 34 residing therein. Lumen 32*b* extends between a cable ingress extent 32*b*', through which cable 26 enters lumen 32*b*, and a securement extent 32*b*" at which carapace 32 couples with securement region 60 of housing 13 (as seen in FIG. 3B and further described hereinbelow).

Guide 34 is disposed in lumen 32*b* and has an elongate body 34*a* wherein external surface 34*b* thereabout and interior lumen 34*c* thereinside together define a guide wall 34*d* therebetween. Guide lumen 34*c* accommodates slider 30 therewithin and has one or more longitudinal recesses 34*e* defined therealong to receive corresponding protrusions 30*a* defined along a longitudinal extent 30*b* of slider 30. The coupling of recesses 34*e* with protrusions 30*a* permits linear reciprocation of slider 30 and simultaneously prohibits axial rotation thereof relative to guide 34. In addition, guide lumen 34*c* optionally provides one or more tabs 34*f* that engage corresponding notches 28*d* defined at motion output extent 28*e* of sheath 28, thereby attenuating axial rotation of sheath 28 relative to guide 34. Guide 34 further includes a threaded region 34*g* that cooperates with corresponding threads of cable nut 39 adjacent thereto. Guide 34 also includes engagement means 34*k* that cooperate with corresponding cam engagement means 70 defined at securement region 60. Guide engagement means 34*k*, together with cam engagement means 70, inhibits axial rotation of guide 34 thereby as is further explained hereinbelow.

Figure 2B:
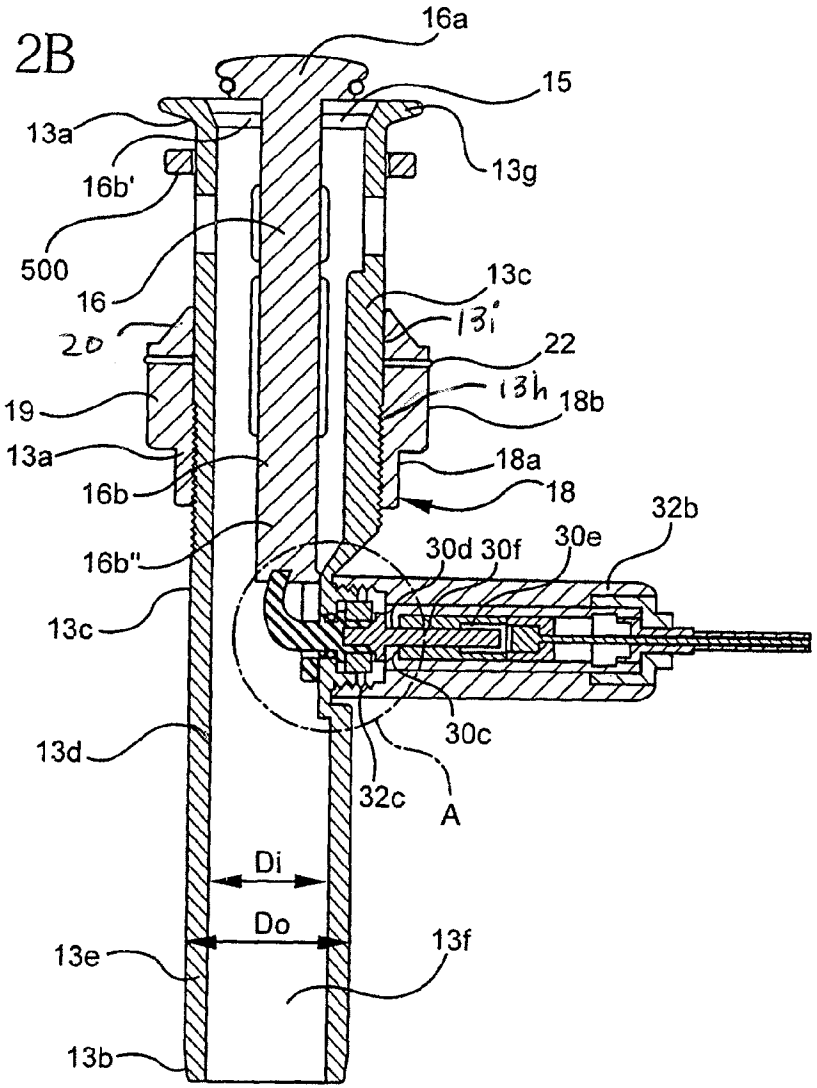
FIG. 2B is a partial view of FIG. 2 showing the drain assembly thereof.

Further referring to slider 30, a cable receiving region 30*c* thereof engages a motion output extent 26*a* of cable 26. Cable receiving region 30*c* receives a depending member 26*c* located at motion output extent 26*a* of cable 26 to ensure sufficient coupling of slider 30 and cable 26 without sacrificing the flexibility and stiffness benefits of the latter. In the alternative, fastening of cable 26 at cable receiving region 30*c* may be effected by frictional or snap-tight engagement, employment of a fastening element, epoxy or any other known fastening means that is amenable to practice of the present invention. An opposing rotator receiving extent 30*d* of slider 30 engages a rotator 40 to effect movement thereof. Rotator 40 has a generally linear body 40*a* bearing a helical extent 40*b* and a cam extent 40*c* from which rotator cam 40*d* depends generally normally. Helical extent 40*b* cooperates with slider receiving region 30*e* having an ingress 30*f* defined at rotator receiving extent 30*d* (see FIG. 2B), wherein ingress 30*f* permits unimpeded entry of helical extent 40*b* into receiving region 30*e*. Slider 30 exhibits smooth linear movement relative to rotator body 40*b* along a path of about 12 mm to 20 mm (corresponding to complete closure and opening of stopper 16 as described hereinbelow). Meanwhile, rotator 40 refrains from linear movement but experiences axial rotation due to the motion input from cable 26. Rotator cam 40*d* has a plurality of spline features 40*e* arranged radially around the central axis of rotation and engaging corresponding spline features 66*b* provided at securement region 60 (as further described hereinbelow). It is desirable, but not essential, to provide at least 12 spline features 40*e*.

Slider 30 further includes one or more detents 30*g* disposed along longitudinal extent 30*b* thereof. As slider 30 moves along helical extent 40*b*, each detent 30*g* correspondingly travels along a first detent path 34*h* defined through guide wall 34*d*. As detent 30*g* approaches a stop 34*i* in guide wall 34*d*, continuing actuation of pull knob 31 imparts motion to cable 26 and delivers detent 30*g* past stop 34*i* to a second detent path 34*j* that corresponds to an uppermost extent to which pull knob 31 may be elevated. Lowering of pull knob 31 will similarly deliver detent 30*g* from second detent path 34*j* past stop 34*i* and to an extent 34*h*' of first detent path 34*h* corresponding to a lowermost extent of pull knob 31. Stop 34*i* temporarily retards linear actuation of slider 30 so that delivery of detent 30 therepast provides a tactile indication to the user of the actuation member's range of motion. Thus, when the user feels engagement of detent 30*g* with stop 34*i* during elevation or lowering of pull knob 31, the user knows that pull knob 31 has reached either the highest extreme or the lowest extreme, respectively, at which pull knob 31 can travel, and that further actuation is neither necessary nor recommended. It is understood that this detent feature is anticipated for use with a plurality of actuation members as described hereinabove and is not limited to use with a pull knob as shown herein.

Now referring to securement region 60, securement extent 32*b*" of carapace 32 is removably attached thereto. Although any fastening means may be employed that is amenable to practice of the present invention, securement region 60 as shown herein includes threaded abutment 56 having external threads 62 that complement internal threads 32*c* at securement extent 32*b*" of carapace lumen 32*b*. Distal extent 56*a* of threaded abutment 56 is desirably defined so as not to extend beyond housing outer diameter $D_o$. Securement region 60 may therefore be recessed from outer circumferential surface 13*e* so that drain stopper assembly 12 is readily inserted in the diametrical parameters of preexisting plumbing structure, enabling instant coupling of securement region with actuation assembly 14. It is noted that outer diameter $D_o$ may vary along the length of housing body 13*d*. Distal extent 56*a* is therefore measured with reference to the maximum outer diameter defined along the housing body.

Threaded abutment 56 includes a receiving region 56*b* in which rotatable stopper lift cam 64 is disposed. Stopper lift cam 64 includes a driveshaft portion 66 having a cam receiving region 66*a* for receipt and capture of rotator cam 40*d* therewithin and spline features 66*b* corresponding to spline features 40*e* of rotator cam 40*d*. Stopper lift cam 64 further includes stop member 64*a* that cooperates with upper stop 56*b*' and lower stop 56*b*" defined in receiving region 56*b*. Stops 56*b*' and 56*b*" constrain the arcuate path along which stop member 64*a* travels and thereby effects corresponding opening and closure of stopper 16. It is desirable to place stops 56*b*' and 56*b*" at or about 120° relative to one another. In this disposition, a vertically applied force on stopper 16 will not affect the stopper's stability and alignment in drain stopper assembly 12, thereby preventing premature rotation of stopper lift cam 64 and ensuring that stopper 16 remains in a fully open position as long as desired.

Cam engagement means 70 that are included in securement region 60 cooperate with corresponding guide engagement means 34*k*. Cam engagement means 70 may be formed integrally within securement region 60 or may be installed as a component of a replaceable insert 72. Guide engagement means 34*k* is depicted herein as a plurality of evenly spaced teeth 34*k*' that engage similarly sized and spaced teeth 70*a* of cam engagement means 70. This configuration prevents axial rotation of guide 34 relative to securement region 60 and thereby prevents inadvertent axial rotation of slider 30 during actuation of cable 26.

Upon coupling of carapace 32 with threaded abutment 56, rotator cam spline features 40*e* first engage driveshaft spline features 66*b*, preventing the potential for inadvertent turning of rotator cam 40*d* and corresponding elevation of stopper 16 (thereby compromising the seal integrity thereof). When teeth 34*k*' and 70*a* are employed as engagement means, they must mesh sufficiently to prevent such turning of rotator cam 40*d*. It is therefore desirable to provide no more than 12 such teeth wherein each such tooth has a sloped front surface. This configuration ensures unidirectional rotation of rotator cam 40*d* during alignment thereof with cam receiving region 66*a*. It is understood that guide engagement means 34*k* and cam engagement means 70 are not limited to meshing teeth as depicted herein and may alternatively comprise other engagement means without departing from the scope of the present invention.

Stopper lift cam 64 further includes middle finger 74 that extends through housing 13. Rotation of rotator cam 40*d* within cam receiving region 66*a* correspondingly rotates middle finger 74 for selective engagement with shaft free extent 16*b*". Disposed between cam receiving region 66 and finger 74 are proximal annular flange 76 and distal annular flange 78 defining annular space 80 therebetween. Annular space 80 accommodates placement of sealing member 82 therein, depicted herein as an O-ring that facilitates rotational movement of stopper lift cam 64. Stopper lift cam 64 and sealing member 82 advantageously are disposed independently of carapace 32 and its contents so that drain stopper assembly 12 remains sealed even if stopper 16 becomes disengaged therefrom. Rotation of stopper lift cam 64 therefore remains unimpeded without compromising the integrity of the seal.

In use, actuation of pull knob 31 (or like actuator) imparts movement to cable 26 at motion input extent 26*b* thereof. Motion transmitted along cable 26 is translated to slider 30 at motion output extent 26*a*, causing reciprocating movement of the slider along helical extent 40*b*. Rotator 40 rotates axially relative to guide 34 and carapace 32 such that spline features 40*e* on rotary cam 40*d* communicate rotary motion with spline features 66*b* of stopper lift cam 64. Stopper lift cam 64 rotates likewise to raise middle finger 74 into contact with shaft free extent 16*b*". Finger 74 thereby elevates closure head 16*a* above fluid egress 15 to bring stopper 16 to an open position. Further actuation similarly imparts rotary motion to rotator 40, thereby releasing middle finger 74 from engagement with shaft free extent 16*b*". Shaft 16*b* accordingly descends within housing lumen 13*f*, and closure head 16*a* correspondingly obstructs fluid egress 15 to prevent escape of fluid from the sanitary vessel.

It is desirable to provide housing 13 as an integral member that significantly reduces installation time in view of conventional multi-piece drain stopper assemblies. In this manner, drain stopper assembly 12 readily installs in pre-existing plumbing structure to eliminate leak paths between the drain stopper assembly and a tailpipe or other fluid flow member with which the drain stopper assembly is installed. In addition, stopper 16 and actuation assembly 14 (either in toto or selected portions thereof) may be pre-assembled with drain assembly 10 at the manufacturing site, thereby realizing significant time savings with respect to assembly and installation. By sealing such components at the factory, the present obviates the need to inspect and adjust the drain assembly for leaks, thereby realizing further time saving benefits.

The present invention anticipates alternate methods of translating motion from cable 26 to a reciprocatable stopper as being within the scope thereof. It is well understood that equivalent motion transmission arrangements may be used in the successful operation of the present invention and the disclosure herein does not act as a limitation thereof. For instance, FIGS. 5, 5A and 5B show an alternative drain assembly 100 incorporated in sanitary vessel S. Drain assembly 100 includes a drain stopper assembly 112 having an elongate housing 113 disposed in communication with an adjacent tailpipe portion 115, either as a cooperating member or an integral portion thereof, such that longitudinal axis 1' of housing 113 is coincident with the longitudinal axis of tailpipe 115. Each of housing 113 and tailpipe 115 have a lumen 113*a* and 115*a* defined respectively therethrough, which housing and tailpipe lumens accommodating reciprocatable movement of elongate stopper 116 therewithin. An annular gasket 118 is disposed along at least a portion of housing circumferential surface 113*b*, which portion may include one or more threads therealong. Gasket 118 desirably assumes a frustoconical or hexagonal geometry or any other geometry that facilitates ready tightening of the gasket and achievement of a seal upon initial installation of drain assembly 100. Actuation assembly 114 (identified in Section B of FIG. 5) that is operatively coupled with cable 26 and drain stopper assembly 112 includes rack and pinion assembly 114*a* disposed along one of housing 113 and tailpiece 115. Motion translated from cable 26 (see arrow A of FIG. 5B) imparts rotational motion to rotating cam member 120 having finger 124 depending outwardly therefrom, thereby elevating and lowering stopper 116 in correspondence therewith.

Figure 6B:
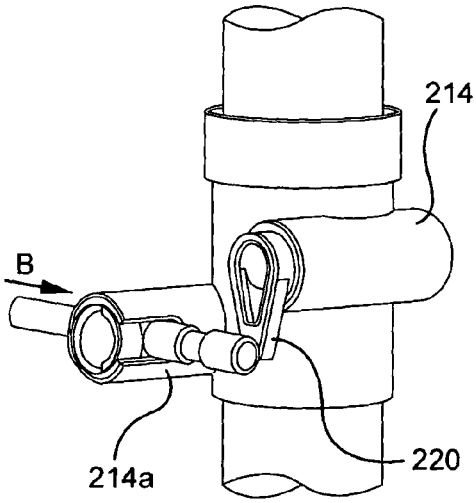
FIG. 6B is an enlarged view of Section C of FIG. 6.

FIGS. 6, 6A and 6B show a second alternative drain assembly 200 incorporated in sanitary vessel S. Drain assembly 200 includes a drain stopper assembly 212 having an elongate housing 213 disposed in communication with an adjacent tailpipe portion 215 as described with respect to drain stopper assembly 112 of FIGS. 5, 5A and 5B. Each of housing 213 and tailpipe 215 have a lumen 213*a* and 215*a* defined respectively therethrough, which housing and tailpipe lumens accommodating reciprocatable movement of elongate stopper 216 therewithin. An annular gasket 218 (similar to gasket 118 described hereinabove with reference to drain stopper assembly 112) is disposed along at least a portion of housing circumferential surface 213*b*, which portion may include one or more threads therealong. Actuation assembly 214 (identified in section C of FIG. 6) that is operatively coupled with cable 26 and drain stopper assembly 212 includes lever assembly 214*a* is disposed along one of housing 213 and tailpiece 215. Motion translated from cable 26 (see arrow B of FIG. 6B) imparts pivotable movement to lever mechanism 220 and corresponding pivoting motion to finger 224 to elevate and lower stopper 216 in accordance therewith.

Figure 7:
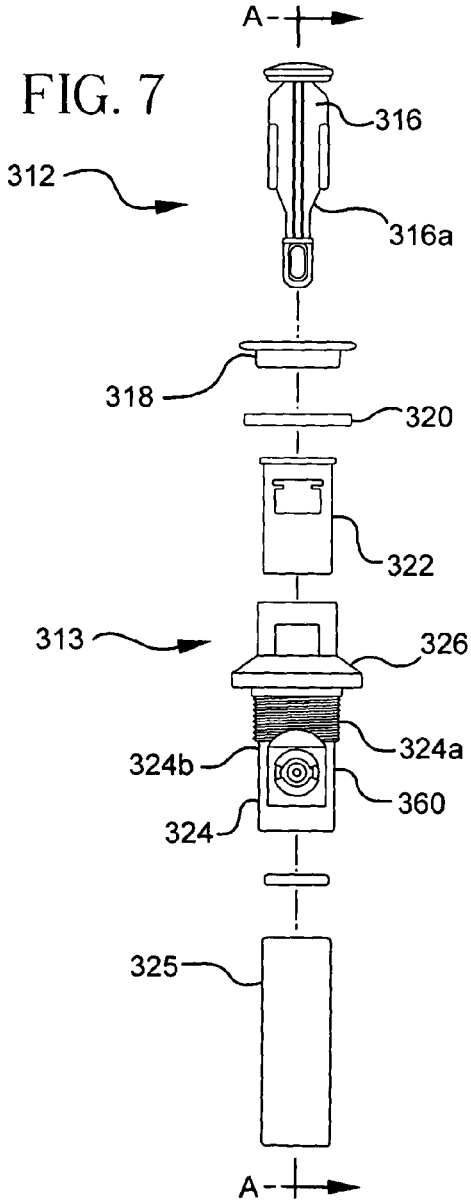
FIG. 7 is an exploded view of a third alternative embodiment drain stopper assembly for use in the drain assembly of the present invention.
Figure 7A:
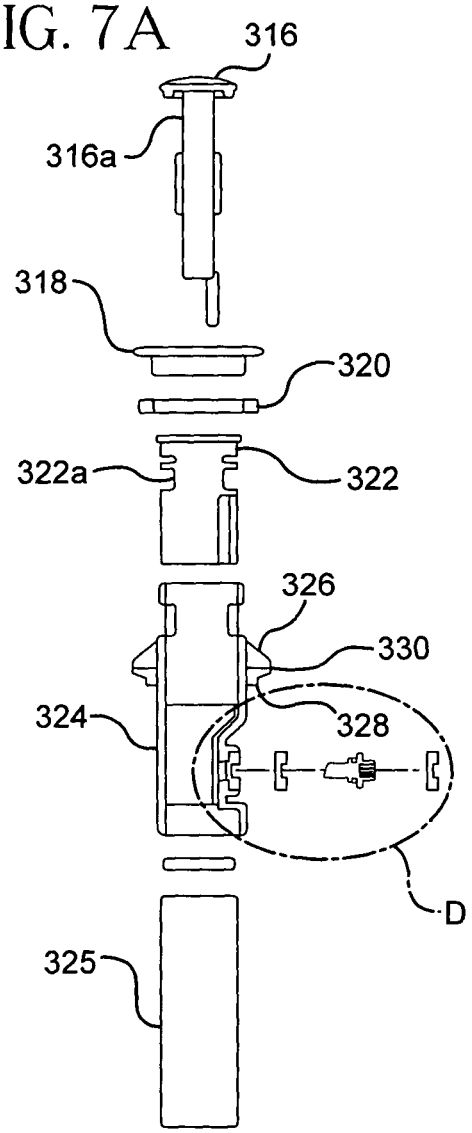
FIG. 7A is a sectional view taken along line A-A of FIG. 7.
Figure 7B:
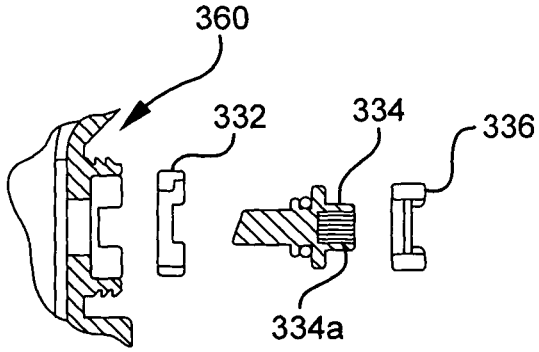
FIG. 7B is an exploded view of Section D of FIG. 7A.

Now referring to FIGS. 7, 7A and 7B, a third alternative embodiment drain stopper assembly 312 is provided wherein housing 313 thereof is a multi-piece configuration (not a one-piece configuration as described hereinabove). Drain stopper assembly 312 includes stopper 316 of similar configuration to stopper 16 described with respect to drain stopper assembly 12. Stopper 316 is disposed adjacent separable flange 318 and washer 320 so that a shaft portion 316*a* of stopper 316 enters drain insert 322 and exhibits reciprocatable movement in lumen 322*a* thereof. Drain insert 322, in turn, is insertable in drain body 324 that establishes fluid communication with tailpipe 325 and is selectively integral therewith. Drain body 324 includes a threaded portion 324*a* defined on at least part of outer circumferential surface 324*b* thereof. A frustoconical or hexagonal gasket 326 is disposed over at least a portion of threaded portion 324*a* adjacent an annular gasket 328. Gaskets 326 and 328 together may retain a sealing member 330 therebetween or, alternatively, either washer may capture sealing member 330 in a groove as described hereinabove with respect to drain assembly 10. Although drain insert 322 is shown as a separate member of drain stopper assembly 312, it is understood that drain insert 322 may be fabricated as an integrally formed portion of drain body 324.

A securement region 360 defined along drain body surface 324*b* (and shown in an exploded view in section D of FIG. 7A) desirably accommodates cam insert 332 thereby such that a lift cam 334 is readily positionable relative thereto and fastenable via placement of cam nut 336 thereadjacent. A rotator cam 40*d* is insertable in a cam receiving region 334*a* of lift cam 334 so as to rotate an elevation member thereof (not shown) and correspondingly elevate and lower stopper 316 (wherein such operation is described hereinabove). The disclosed configuration for securement region 360 is not limited to use with drain stopper assembly 312 and may also be incorporated with drain assemblies 10, 100 and 200 as described hereinabove.

All of the above embodiments are readily fabricated from plastic or any other material conducive to successful operation of the present invention. Drain stopper assembly 312 is particularly amenable to fabrication from metal or from plastic in accordance with predetermined tolerance specifications.

Conventional drain devices utilize multiple components that must be installed and adjusted during installation, including components that require formation of a watertight seal. The present invention requires no adjustment or formation of watertight seals during installation; a single connection is required at the drainpipe, and this connection is easily visible and accessible. In addition, the present invention drain assembly, unlike conventional drain assembly configurations, does not require a predefined alignment relative to preexisting plumbing structure. The drain assembly may be installed with the stopper lift mechanism facing any one of several directions that facilitate connection with the motion translation device. The present invention thereby benefits users in diverse installations by substantially reducing the opportunities for improper installation and malfunction of the instant drain apparatus. For both professionals and do-it-yourselfers, the commitment of time and effort inherent in the installation of drain devices deservedly merits that such devices inherently promote rapid installation without compromising long-term functional supremacy. The present invention provides predictably quick installation capabilities in a plurality of sanitary installations and simultaneously provides such installations with enhanced operational benefits.

Various changes to the foregoing described and shown structures are now evident to those skilled in the art. The matter set forth in the foregoing description and accompanying drawings is therefore offered by way of illustration only and not as a limitation. Accordingly, the particularly disclosed scope of the invention is set forth in the following claims.

What is claimed is:

1. A drain assembly for use in a sanitary vessel, comprising:

a drain stopper assembly having:

an elongate one-piece housing with a longitudinal axis defined therealong, said housing including a proximal extent for disposal proximate a vessel surface, an opposing distal extent for disposal proximate a waste outlet and a longitudinal body coextensive with said proximal and distal extents and defining a lumen therein, said body having each of an inner circumferential surface of predetermined inner diameter and an outer circumferential surface of predetermined outer diameter;

a flange portion proximate said proximal extent wherein said flange portion has a fluid egress for delivery of fluids from said sanitary vessel to said housing lumen;

a linearly reciprocatable drain stopper having a closure head from which an elongate shaft depends generally normally so that a longitudinal axis thereof is coincident with said housing longitudinal axis, said shaft having a proximal extent adjacent said closure head and an opposing free extent, wherein said stopper has a fully closed position wherein said closure head obstructs said fluid egress and a fully open position wherein said fluid egress remains unobstructed; and a securement region provided on said outer housing surface along said longitudinal body thereof and having a receiving region defined therewith;

and an actuation assembly having a motion translation device in communication with a drain articulation device, said securement region effecting operational communication between said drain stopper assembly and said actuation assembly so that operation of said drain articulation member effects reciprocating motion of said drain stopper, wherein the motion translation device includes a motion input extent coupled with said drain articulation device and a motion output extent coupled with said actuation assembly, and wherein said actuation assembly includes a motion transfer mechanism, said motion transfer mechanism comprising:

a carapace having an elongate body and a lumen therein, said lumen extending between a motion translation device ingress extent through which said motion translation device enters said lumen and a securement extent at which said carapace couples with said securement region;

a guide disposed in said carapace lumen and restrained from movement therewithin, said guide having an elongate body wherein an external surface and an internal lumen thereof together delineate a guide wall;

a slider disposed in said guide lumen, said slider having a longitudinal body with a motion translation device receiving extent defined at one end thereof for engagement with said motion translation device and an opposed rotator receiving extent;

wherein that said carapace, said guide and said slider are disposed in coaxial intussusception with one another.

2. The drain assembly of claim 1, wherein said drain articulation device is selected from one of a plurality of drain articulation devices including, but not limited to, pivotable levers, pull levers, push buttons and rotatable knobs and handles.

3. The drain assembly of claim 1, wherein said motion translation device comprises one of a push-pull cable or a flexible shaft.

4. The drain assembly of claim 3, wherein said motion translation device comprises a push-pull cable of predetermined length and having a sheath disposed over at least a portion thereof.

5. The drain assembly of claim 4, wherein said cable includes each of a motion input extent coupled with said drain articulation device and a motion output extent coupled with said actuation assembly, and said sheath includes a motion input extent defined proximate said cable motion input extent and a sheath output extent defined proximate said cable motion output extent.

6. The drain assembly of claim 1, wherein said guide lumen has one or more longitudinal recesses defined therealong to receive corresponding protrusions defined along a longitudinal extent of said slider.

7. The drain assembly of claim 1, wherein said guide lumen includes at least one tab that engage corresponding notches defined at said sheath motion output extent.

8. The drain assembly of claim 1, wherein the motion translation device is a cable and said guide includes a threaded region that cooperates with corresponding threads of a cable nut disposed adjacent thereto.

9. The drain assembly of claim 1, wherein said actuation assembly further includes:

a rotator having a generally linear body, said body having a helical extent and an opposed cam extent from which a rotator cam depends generally normally, said helical extent cooperating with a slider receiving region defined in said slider and having an ingress for entry of said helical extent into said receiving region for linear movement of said slider relative to said rotator; and a stopper lift cam having a driveshaft portion in which a cam receiving region captures said rotator cam and a finger extending through said housing that selectively engages said stopper upon rotation thereof.

10. The drain assembly of claim 9, wherein said slider movement comprises a distance of about 12 mm to about 20 mm, inclusive.

11. The drain assembly of claim 9, wherein said rotator cam has a central axis of rotation around which a plurality of spline features are radially and evenly disposed, said rotator cam spline features being in cooperation with corresponding spline features defined in said cam receiving region.

12. The drain assembly of claim 9, wherein said stopper lift cam includes at least one stop member for engagement with an upper stop and a lower stop defined in said receiving region of said securement region.

13. The drain assembly of claim 12, wherein said upper stop and said lower stop are disposed at or about 120° relative to one another.

14. The drain assembly of claim 9, wherein a proximal annular flange and a distal annular flange are disposed between said cam receiving region and said finger, said flanges defining an annular space therebetween that can accommodate a sealing member therein.

15. The drain assembly of claim 9, wherein said guide includes engagement means that cooperate with corresponding cam engagement means defined at said securement region.

16. The drain assembly of claim 15, wherein said guide engagement means comprises a plurality of evenly spaced teeth disposed radially about a longitudinal axis of said guide, wherein each said tooth engages at least one corresponding tooth of said cam engagement means.

17. The drain assembly of claim 1, wherein said slider includes at least one detent disposed along said longitudinal body thereof, said at least one detent engaging stop means defined on said guide.

18. The drain assembly of claim 1, wherein said securement region comprises a threaded abutment that terminates in a distal extent.

19. The drain assembly of claim 18, wherein said distal extent does not extend beyond said predetermined outer diameter of said housing outer surface.

20. The drain assembly of claim 1, wherein said stopper includes at least one tapered wing portion defined along at least a portion of said stopper shaft.

21. The drain assembly of claim 20, wherein said at least one tapered portion includes one or more wings protruding therefrom.

22. The drain assembly of claim 1, wherein said stopper includes at least one locking member defined at the free extent of the stopper.

23. The drain assembly of claim 1, further comprising at least one gasket nut disposed adjacent said housing outer surface and at least one frustoconical gasket disposed thereadjacent so as to overlie a portion of said housing outer surface.

24. The drain assembly of claim 23, wherein said gasket nut includes at least one index defined thereon, said index being selected from a group of tactile indices that facilitate gripping of said gasket nut and a group of visual indices that indicate proper alignment of said gasket nut relative to said housing outer surface.

25. The drain assembly of claim 23, wherein at least one sealing member is disposed between said gasket nut and said frustoconical gasket.

26. The drain assembly of claim 23, wherein said housing outer surface includes a threaded region along at least a portion thereof, said gasket nut overlying at least a portion of said threaded region.

27. The drain assembly of claim 1, wherein the flange portion is at the proximal end of the housing and is integral with the housing.

28. The drain assembly of claim 27, wherein the housing, the flange portion and the securement region comprise an integral member.

29. The drain assembly of claim 28, wherein free extent of the shaft is disposed in said housing lumen.

30. The drain assembly of claim 1, wherein the free extent of the shaft is disposed in said housing lumen.

31. The drain assembly of claim 1, wherein the housing, the flange portion and the securement region comprise an integral member.

32. An improved sink drain assembly, comprising:

a drain stopper assembly having:

an elongate housing with a longitudinal axis defined therealong, said housing including a proximal extent for disposal proximate a vessel surface, an opposing distal extent for disposal proximate a waste outlet and a longitudinal body coextensive with said proximal and distal extents and defining a lumen therein, said body having each of an inner circumferential surface of predetermined inner diameter and an outer circumferential surface of predetermined outer diameter;

a flange portion proximate said proximal extent wherein said flange portion has a fluid egress for delivery of fluids from said sanitary vessel to said housing lumen;

a linearly reciprocatable drain stopper having a closure head from which an elongate shaft depends generally normally so that a longitudinal axis thereof is coincident with said housing longitudinal axis, said shaft having a proximal extent adjacent said closure head and an opposing free extent, wherein said stopper has a fully closed position wherein said closure head obstructs said fluid egress and a fully open position wherein said fluid egress remains unobstructed; and a securement region provided on said outer housing surface along said longitudinal body thereof and having a receiving region defined therewith, wherein the securement region is recessed from the outer circumferential surface of the housing;

and an actuation assembly detachably couplable with said securement region so as to effect operational communication between said drain stopper assembly and said actuation assembly upon operation of a drain articulation device and correspondingly effect reciprocating motion of said drain stopper; said actuation assembly comprising:

a motion translation device in communication with a drain articulation member; and a motion transfer mechanism that facilitates operative communication between said motion translation device and said drain stopper assembly, wherein said motion transfer mechanism comprises:

a carapace having an elongate body and a lumen therein, said lumen extending between a cable ingress extent through which said cable enters said lumen and a securement extent at which said carapace couples with said securement region;

a guide disposed in said carapace lumen and restrained from movement therewithin, said guide having an elongate body wherein an external surface and an internal lumen thereof together delineate a guide wall; and a slider disposed in said guide lumen, said slider having a longitudinal body with a cable receiving extent defined at one end thereof for engagement with said cable and an opposed rotator receiving extent;

wherein that said carapace, said guide and said slider are disposed in coaxial intussusception with one another.

33. The drain assembly of claim 32, wherein said drain articulation device is selected from one of a plurality of drain articulation devices including, but not limited to, pivotable levers, pull levers, push buttons and rotatable knobs and handles.

34. The drain assembly of claim 32, wherein said motion translation device comprises a push-pull cable of predetermined length and diameter having a sheath disposed over at least a portion thereof.

35. The drain assembly of claim 34, wherein said predetermined length does not exceed 550 mm.

36. The drain assembly of claim 35, wherein said predetermined length is about 450 mm to 550 mm, inclusive.

37. The drain assembly of claim 34, wherein said cable is fabricated from stainless steel.

38. The drain assembly of claim 34, wherein said cable has a diameter of about 1.4 mm to 2.3 mm, inclusive.

39. The drain assembly of claim 38, wherein said cable has a diameter of about 1.8 mm.

40. The drain assembly of claim 34, wherein said cable includes each of a motion input extent coupled with said drain articulation device and a motion output extent coupled with said actuation assembly, and said sheath includes a motion input extent defined proximate said cable motion input extent and a sheath output extent defined proximate said cable motion output extent.

41. The drain assembly of claim 40, wherein said sheath includes an alignment and guide member proximate said cable motion input extent.

42. The drain assembly of claim 41, wherein said alignment and guide member includes at least one aperture defined therein to facilitate fluid egress prior to fluid contact with said cable.

43. The drain assembly of claim 32, wherein said guide lumen has one or more longitudinal recesses defined thereallong to receive corresponding protrusions defined along a longitudinal extent of said slider.

44. The drain assembly of claim 32, wherein said guide lumen includes at least one tab that engages corresponding notches defined at said sheath motion output extent.

45. The drain assembly of claim 32, wherein said guide includes a threaded region that cooperates with corresponding threads of a cable nut disposed adjacent thereto.

46. The drain assembly of claim 32, wherein said actuation assembly further includes:

a rotator having a generally linear body, said body having a helical extent and an opposed cam extent from which a rotator cam depends generally normally, said helical extent cooperating with a slider receiving region defined in said slider and having an ingress for entry of said helical extent into said receiving region for linear movement of said slider relative to said rotator; and a stopper lift cam having a driveshaft portion in which a cam receiving region captures said rotator cam and a finger extending through said housing that selectively engages said stopper upon rotation thereof.

47. The drain assembly of claim 46, wherein said slider movement comprises a distance of about 12 mm to about 20 mm, inclusive.

48. The drain assembly of claim 46, wherein said rotator cam has a central axis of rotation around which a plurality of spline features are radially and evenly disposed, said rotator cam spline features being in cooperation with corresponding spline features defined in said cam receiving region.

49. The drain assembly of claim 48, wherein no less than 12 rotator cam spline features are provided.

50. The drain assembly of claim 46, wherein said stopper lift cam includes at least one stop member for engagement with an upper stop and a lower stop defined in said receiving region of said securement region.

51. The drain assembly of claim 50, wherein said upper stop and said lower stop are disposed at or about 120° relative to one another.

52. The drain assembly of claim 46, wherein a proximal annular flange and a distal annular flange are disposed between said cam receiving region and said finger, said flanges defining an annular space therebetween that accommodates placement of a sealing member therein.

53. The drain assembly of claim 46, wherein said guide includes engagement means that cooperate with corresponding cam engagement means defined at said securement region.

54. The drain assembly of claim 53, wherein said guide engagement means comprises a plurality of evenly spaced teeth disposed radially about a longitudinal axis of said guide, wherein each said tooth engages at least one corresponding tooth of said cam engagement means.

55. The drain assembly of claim 54, wherein at least one of said teeth of said guide engagement means has a predefined angle of inclination defined at said engagement extent thereof.

56. The drain assembly of claim 54, wherein said guide engagement means comprises at least 12 said teeth.

57. The drain assembly of claim 53, wherein said cam engagement means is provided on a removable insert that is detachably coupled with said securement region.

58. The drain assembly of claim 32, wherein said slider includes at least one detent disposed along said longitudinal body thereof, said at least one detent engaging stop means defined on said guide.

59. The drain assembly of claim 32, wherein said securement region comprises a threaded abutment that terminates in a distal extent.

60. The drain assembly of claim 59, wherein said distal extent does not extend beyond said predetermined outer diameter of said housing outer surface.

61. The drain assembly of claim 60, wherein said outer diameter does not exceed 41 mm.

62. The drain assembly of claim 32, wherein the flange portion is at the proximal end of the housing and is integral with the housing.

63. The drain assembly of claim 62, wherein the housing, the flange portion and the securement region comprise an integral member.

64. The drain assembly of claim 63, wherein free extent of the shaft is disposed in said housing lumen.

65. The drain assembly of claim 32, wherein the free extent of the shaft is disposed in said housing lumen.

66. The drain assembly of claim 32, wherein the housing, the flange portion and the securement region comprise an integral member.

67. A drain assembly for use in sanitary vessel, comprising:

a drain stopper assembly having:

an elongate one-piece housing with a longitudinal axis defined therealong, said housing including a proximal extent for disposal proximate a vessel surface, an opposing distal extent for disposal proximate a waste outlet and a longitudinal body coextensive with said proximal and distal extents and defining a lumen therein, said body having each of an inner circumferential surface of predetermined inner diameter and an outer circumferential surface of predetermined outer diameter;

a flange portion proximate said proximal extent wherein said flange portion has a fluid egress for delivery of fluids from said sanitary vessel to said housing lumen;

a linearly reciprocatable drain stopper having a closure head from which an elongate shaft depends generally normally so that a longitudinal axis thereof is coincident with said housing longitudinal axis, said shaft having a proximal extent adjacent said closure head and an opposing free extent, wherein said stopper has a fully closed position wherein said closure head obstructs said fluid egress and a fully open position wherein said fluid egress remains unobstructed; and a securement region provided on said outer housing surface along said longitudinal body thereof and having a receiving region defined therewith;

and an actuation assembly having a motion translation device in communication with a drain articulation device and a motion transfer mechanism, wherein said receiving region of said securement region and the actuation assembly operate together to effect reciprocating motion of the drain stopper assembly upon operation of the drain articulation member, wherein said motion translation device comprises one of a push-pull cable or a flexible shaft and said motion translation device has a motion input extent coupled with said drain articulation device and a motion output extent coupled with said actuation assembly, said motion translation device having a sheath disposed over at least a portion thereof; said sheath including a motion input extent defined proximate said motion translation device motion input extent, a sheath output extent defined proximate said motion translation device motion output extent, and an alignment and guide member proximate said motion translation device motion input extent, wherein said alignment and guide member includes at least one aperture defined therein to facilitate fluid egress prior to fluid contact with said motion translation device.

68. A drain assembly for use in sanitary vessel, comprising:

a drain stopper assembly having:

an elongate one-piece housing with a longitudinal axis defined therealong, said housing including a proximal extent for disposal proximate a vessel surface, an opposing distal extent for disposal proximate a waste outlet and a longitudinal body coextensive with said proximal and distal extents and defining a lumen therein, said body having each of an inner circumferential surface of predetermined inner diameter and an outer circumferential surface of predetermined outer diameter;

a flange portion proximate said proximal extent wherein said flange portion has a fluid egress for delivery of fluids from said sanitary vessel to said housing lumen;

a linearly reciprocatable drain stopper having a closure head from which an elongate shaft depends generally normally so that a longitudinal axis thereof is coincident with said housing longitudinal axis, said shaft having a proximal extent adjacent said closure head and an opposing free extent, wherein said stopper has a fully closed position wherein said closure head obstructs said fluid egress and a fully open position wherein said fluid egress remains unobstructed;

a securement region provided on said outer housing surface along said longitudinal body thereof and having a receiving region defined therewith;

and an actuation assembly having a motion translation device in communication with a drain articulation device, wherein said receiving region of said securement region and the actuation assembly operate together to effect reciprocating motion of the drain stopper assembly upon operation of the drain articulation member, wherein said motion translation device comprises one of a push-pull cable or a flexible shaft and said motion translation device has a motion input extent coupled with said drain articulation device and a motion output extent coupled with said actuation assembly, wherein said actuation assembly includes a motion transfer mechanism, and said motion transfer mechanism comprises:

a carapace having an elongate body and a lumen therein, said lumen extending between a motion translation device ingress extent through which said motion translation device enters said lumen and a securement extent at which said carapace couples with said securement region;

a guide disposed in said carapace lumen and restrained from movement therewithin, said guide having an elongate body wherein external surface and internal lumen thereof together delineate a guide wall; and a slider disposed in said guide lumen, said slider having a longitudinal body with a motion translation device receiving extent defined at one end thereof for engagement with said motion translation device and an opposed rotator receiving extent;

wherein that said carapace, said guide and said slider are disposed in coaxial intussusception with one another.

69. An improved sink drain assembly, comprising:

a drain stopper assembly having:

an elongate housing with a longitudinal axis defined therealong, said housing including a proximal extent for disposal proximate a vessel surface, an opposing distal extent for disposal proximate a waste outlet and a longitudinal body coextensive with said proximal and distal extents and defining a lumen therein, said body having each of an inner circumferential surface of predetermined inner diameter and an outer circumferential surface of predetermined outer diameter;

a flange portion proximate said proximal extent wherein said flange portion has a fluid egress for delivery of fluids from said sanitary vessel to said housing lumen;

a linearly reciprocatable drain stopper having a closure head from which an elongate shaft depends generally normally so that a longitudinal axis thereof is coincident with said housing longitudinal axis, said shaft having a proximal extent adjacent said closure head and an opposing free extent, wherein said stopper has a fully closed position wherein said closure head obstructs said fluid egress and a fully open position wherein said fluid egress remains unobstructed; and a securement region provided on said outer housing surface along said longitudinal body thereof and having a receiving region defined therewith, wherein the securement region is recessed from the outer circumferential surface of the housing;

and an actuation assembly detachably couplable with said securement region so as to effect operational communication between said drain stopper assembly and said actuation assembly upon operation of a drain articulation device and correspondingly effect reciprocating motion of said drain stopper; said actuation assembly comprising:

a motion translation device in communication with a drain articulation member, wherein said motion translation device comprises a push-pull cable of predetermined length and diameter having a sheath disposed over at least a portion thereof; said cable includes each of a motion input extent coupled with said drain articulation device and a motion output extent coupled with said actuation assembly; said sheath includes a motion input extent defined proximate said cable motion input extent, a sheath output extent defined proximate said cable motion output extent, and an alignment and guide member proximate said cable motion input extent, wherein said alignment and guide member includes at least one aperture defined therein to facilitate fluid egress prior to fluid contact with said cable; and a motion transfer mechanism that facilitates operative communication between said motion translation device and said drain stopper assembly.

* * * * *